United States Patent [19]

Schwarting

[11] Patent Number: 4,483,567

[45] Date of Patent: Nov. 20, 1984

[54] APPARATUS FOR POSITIONING SUPPLY CONNECTIONS INTO ASSOCIATION WITH A MINING EXTRACTOR

[75] Inventor: Karl H. Schwarting, Voerde, Fed. Rep. of Germany

[73] Assignee: M.A.N. Maschinenfabrik Augsburg-Nurnberg Aktiengesellschaft, Fed. Rep. of Germany

[21] Appl. No.: 378,209

[22] Filed: May 14, 1982

[30] Foreign Application Priority Data

Jun. 13, 1981 [DE] Fed. Rep. of Germany ..... 3123473

[51] Int. Cl.[3] ..... E21C 27/34

[52] U.S. Cl. ..... 299/43; 191/12 R

[58] Field of Search ..... 299/42, 43; 191/12 R, 191/12.2 R

[56] References Cited

U.S. PATENT DOCUMENTS

| | | | |
|---|---|---|---|
| 899,613 | 9/1908 | Pifer | 191/12.2 R |
| 3,113,763 | 12/1963 | Wendt et al. | 299/43 |
| 3,721,378 | 3/1973 | Hughes et al. | 299/43 X |
| 3,801,752 | 4/1974 | Gdovichin | 191/12.2 R |
| 3,861,751 | 1/1975 | Erwien | 299/43 |
| 3,882,288 | 5/1975 | Rasmussen | 191/12 R |
| 3,940,577 | 2/1976 | Christofer | 191/12 R |
| 4,067,257 | 1/1978 | Pentith | 299/43 X |
| 4,103,974 | 8/1978 | Nowacki et al. | 299/43 |
| 4,260,191 | 4/1981 | Weber | 299/43 X |

FOREIGN PATENT DOCUMENTS

| | | | |
|---|---|---|---|
| 1247995 | 3/1968 | Fed. Rep. of Germany . | |
| 1266705 | 5/1972 | Fed. Rep. of Germany . | |
| 3123473 | 1/1983 | Fed. Rep. of Germany . | |
| 1012432 | 12/1965 | United Kingdom | 299/49 |
| 1109531 | 4/1968 | United Kingdom | 299/43 |

*Primary Examiner*—James A. Leppink
*Assistant Examiner*—Beverly E. Hjorth
*Attorney, Agent, or Firm*—McGlew and Tuttle

[57] ABSTRACT

An apparatus for positioning supply connections such as cables or connecting hoses into operative association with a mining extractor machine which is movable against a working space along a mining longwall by a longwall conveyor and in a mine between adjacent adits and to the stowage side comprises a connection winding and unwinding drum positionable in an adit and having a supply connection thereon which is unwindable from the drum guided to a supply connection conveyor which moves along the longwall with the extractor.

5 Claims, 3 Drawing Figures

10
5a
11
5
3
2
4
1
9
6
7
8

APPARATUS FOR POSITIONING SUPPLY CONNECTIONS INTO ASSOCIATION WITH A MINING EXTRACTOR

FIELD AND BACKGROUND OF THE INVENTION

The invention relates in general to mining and in particular to a new and useful system for the supply of extraction machines in mining operations with the operating means necessary for its operation such as electric energy, hydraulic or gaseous media.

The extraction machines are moved back and forth in a longwall of a mine at the working face and are, as a rule, guided at the longwall conveyor. The drive of the extraction machine is effected either by pulling means driven from the longwall end or by a drive integrated into the extraction machine. For feeding the driving and operating means there are different solutions. Thus, among others, the energy carrying lines are dragged along and deposited by the extraction machine in a cable conduit disposed at the longwall conveyor on the stowage side. It is then customary to deposit the lines singly or bundled within a flexible cable chain. Further it is known to feed the energy carrying lines in loops to the extraction machine by means of a cable carriage guided in a side timber duct of the longwall conveyor and provided with guide rollers for the lines. The drive of the cable carriage is effected by the extraction machine or by reels set up at the longwall end as a function of the movement of the extraction machine.

At low propulsion speeds of the extraction machine (about 0.1 m/sec), an orderly disposition of the drag lines will still be possible with the first named method. But at higher propulsion speeds this becomes a problem. The relatively high movement resistance of the drag line sliding on the stationary base leads to a short life of the lines. Frequent bending of the lines below the minimum radii increases the danger of fatigue breakes, especially when the longwalls are low. The use of cable drag chains leads to considerable additional noise in the mining operations. Furthermore, also the extracted material collecting in the cable conduit open at the top constitutes a hindrance to proper cable guiding. In addition to the disadvantages mentioned in connection with a drag chain guiding, jerky load applications may occur with the loop type cable guiding, which lead to a strong lateral and/or vertical swinging of the line strands locally. For this reason, sufficiently high timbers must be provided for the formation of the cable conduit, which are an obstacle to their use in relatively low veins.

SUMMARY OF THE INVENTION

The invention provides in particular for use in relatively low veins, an energy supply system which requires as low as possible a height and a small width. It is substantially insensitive to falling rock and mined material and permits safe installation of the line. Also it ensures protective handling with respect to stress and wear of the energy feed lines, even at relatively high propulsion speeds of the extraction machine (0.5 m/sec).

In accordance with the invention there is provided a supply line transport for a chain conveyor which is trained to run alongside the longwall conveyor adjacent the stowage side of the mining operation. In this way the extractor is connected to either a connecting power hose or electrical conduit which is moved by the conduit conveyor in timed relationship to the longwall conveyor for the extractor machine. The supply connection is advantageously wound on a cable drum which is positiioned in an adit adjacent the longwall.

In German Pat. No. 1,247,995, the supply lines are indeed placed on the pulling means of the extraction machine, but exact guiding of the pulling chain and of the lines is missing there. The pulling chain sags in the unsupported sections and the lines lying on it are pushed up against the housing and exposed to strong friction when traveling over humps.

By placing the supply line on a separate transport means, these disadvantages are avoided according to the invention. The supply lines lying horizontally in the longwall on the transport means undergo no wear of any kind and are subjected to very little traction. The trough width and height are small, and the extracted material falling into the trough is transported away toward the longwall end and is discharged there.

Accordingly it is an object of the invention to provide a device for supplying a connecting cable or hose connection or the like to a movable extractor which is movable by a longwall conveyor adjacent a working face of a mine and which will move the supply connection along with the extractor.

A further object of the invention is to provide a device for connecting a supply connection to an extractor of a mining machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
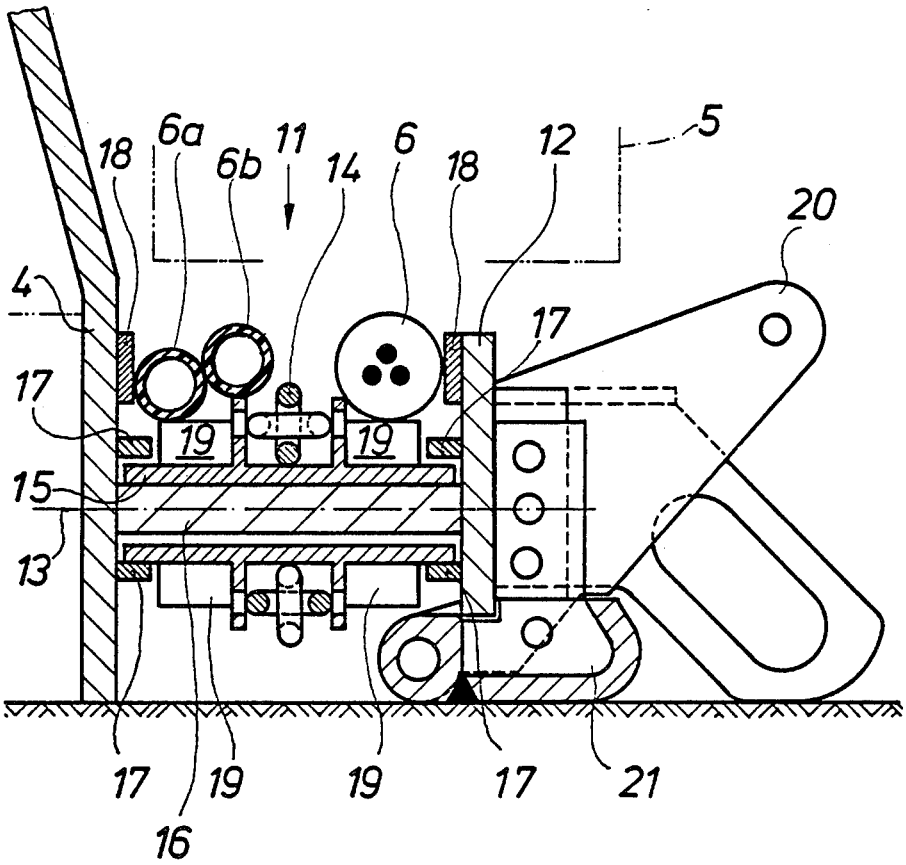
FIG. 2 is an enlarged transverse section through the conveyor shown in FIG. 1 at the location of the extractor.

Referring to the drawings in particular the invention embodied therein comprises an apparatus for positioning supply connections such as cable conduit 6 and energy cables or hoses 6*a* and 6*b* in association with a mining extractor machine 5 which is movable against a working face 2 of a mine along a mining longwall. The extractor is movable along a longwall conveyor 4 in a mine between adjacent adits 7 and 10 opposite to the stowage side 3. In FIG. 2, only a fixed supporting part of conveyor 4 is shown that lies on the stowage side of the conveyor. A movable pusher chain for conveyor 4 is not shown in any of the figures. The apparatus comprises a supply connection winding and unwinding drum 8 positionable in an adit, for example the adit 7.

The supply connection conveyor 11 extends along the longwall on the supply side of the longwall conveyor 4 and is movable with the extractor 5. Guide means in the form of pulleys 9 guide the supply line 6 from the drum 8 to the location of the extractor machine 5.

Figure 1:
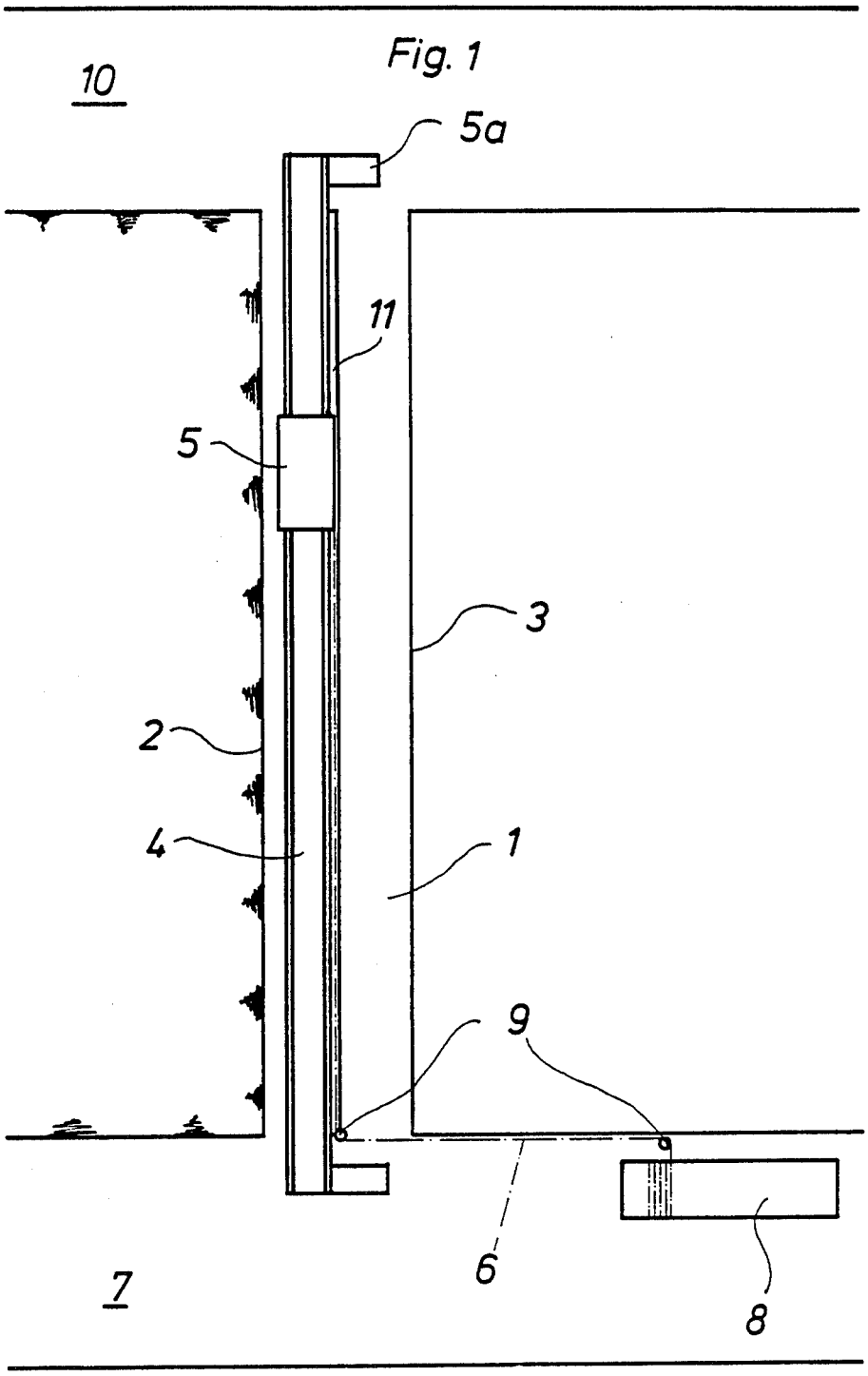
FIG. 1 is a schematic plan view of a mining site showing the connection of the supply lines to an extractor which is movable against a working face along a longwall.

In FIG. 1, 1 denotes the longwall, 2 the working face, and 3 the stowage side. At the working face 2, longwall conveyor 4 is arranged, along which the extraction machine 5 is guided. The supply of energy to the extraction machine 5 moved back and forth at the working face 2 is effected by means of line 6, which is wound up or laid out by cable or hose drum 8 in the adjacent adit 7. The deflection of the line from the longwall 1 into the adit 7 is effected through guide rollers 9. When bringing in several supply lines, they can be wound up on several different drums or be brought in additionally from the other adit 10. At the longwall conveyor 4 a separate supply line transport means 11 is arranged, on which the supply lines 6 are deposited. Design details can be seen from FIG. 2. On the stowage side of conveyor 4, the transport means 11 comprises a cable conduit 12 which includes a plate 16 and which is secured to the longwall conveyor 4 over plate 16 by screws 13. The transport means 11 comprising pulling means or conveyor chain 14 to which is engaged a plurality of discrete flat bearing strips 15 on the bottom plate 16. These strips 15 slide in cable conduit 12. The energy cables 6, **6*a*, 6*b* are deposited on the bearing strips 15 which are disposed on or connected to the pulling means 14 at spacings such as to prevent the lines 6, 6*a*, 6*b* from dragging on the bottom plate 16. That is, a plurality of spaced strips 15 are connected along chain 14. Above and below the bottom plate 16, the conduit 12 has strips or slides 17 which define slots that guide the top and bottom sections or reaches of the transport means 11. At the level of the lines 6, 6*a*, 6*b*, the sidewalls of conduit 12 which define an upper supply line space, are provided with protective applications or strips 18, while the bearing strips 15 have line protecting applications or supports 19. The strips 15 may be symmetrical or asymmetrical to the pulling means or chain 14, and the lines may be deposited singly, side by side or stacked. Chain 14 is an endless chain with upper run on plate 16 and lower run below plate 16 in a lower return space of conduit 12**.

Figure 3:
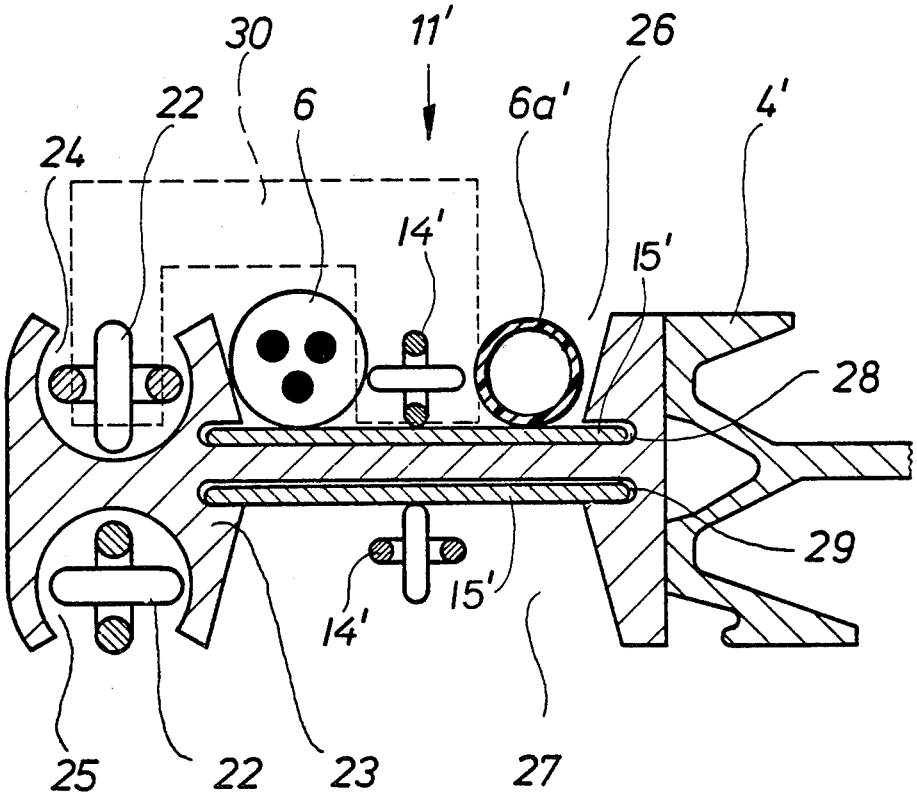
FIG. 3 is a view similar to FIG. 2 extending through the conveyor in the working face arrangement of the supply system.

The drive of the separate transport means 11 is effected as a function of the movement of the extraction machine 5, either by the same drive **5*a* arranged at the longwall end for driving machine 5, or by combination of the pulling means 14 or 22, as shown in FIG. 3 and by devices engaging under or over the longwall conveyor 4 or by the extraction machine 5 itself which is guided on the longwall conveyor. For an extraction machine with integrated drive the pulling means 14 of the transport means 11 is directly coupled with the latter. On the stowage side of conduit 12 are the connecting devices 20 for the longwall timbering and the pushing equipment, as well as the height adjustable skids 21 for the tilt control of the longwall conveyor 4**.

In FIG. 3, similar parts are designated with like or similar numbers. FIG. 3 shows the working face side arrangement of the separate transport means 11', which is here arranged in an appropriately designed common housing 23 with the driving means or chain 22 of the extraction machine. The housing 23 is secured on the longwall conveyor 4' and has guide conduits 24 and 25 for the top and bottom sections or runs of the transport means 11 (chain 22) with guide grooves 28, 29 for the bearing strips 15'. The coupling of the drive means 22 and pulling means 14' is effected through yokes 30 connected between means 14' and 22 or by means of the extraction machine, for which guideways may be provided at the housing 23.

While specific embodiments of the invention have been shown and described in detail to illustrate the application of the principles of the invention, it will be understood that the invention may be embodied otherwise without departing from such principles.

What is claimed is:

1. An apparatus for positioning supply lines for a minining extractor machine which is movable against and along a working face of a longwall of a mine, and guided on a longwall conveyor having a fixed support part extending along the longwall, comprising:

a cable conduit connected to the fixed support part and having an upper supply line space extending along the length of the longwall, and a lower return space extending along the length of the longwall;

an endless supply line chain conveyor having an upper run extending along said upper supply line space and a lower run extending along said lower return space, said endless supply line chain conveyor connected to the mining extractor machine for moving as a function of the movement of the mining extractor machine; and a plurality of flat supply line bearing strips connected at spaced locations along said endless supply line chain conveyor for supporting the supply lines during their movement in said upper supply line space;

said cable conduit including a slot defined in said upper supply line space and a slot defined in said lower return space, each slot extending along the length of the longwall for accommodating said supply line bearing strips.

2. An apparatus according to claim 1, wherein said cable conduit includes a sidewall spaced from the fixed support part and a bottom plate connected between said sidewall and the fixed support part, said upper supply line space defined above said bottom plate and lower return space defined below said bottom plate, a first pair of slides connected to the fixed support part and said sidewall and defining said slot in said upper supply line space, and a second pair of slides connected to the fixed support part and said sidewall and defining said slot in said lower return space.

3. An apparatus according to claim 2, including at least one protective application connected to said sidewall in said upper supply line space for protecting supply lines moving in said upper supply space.

4. An apparatus according to claim 2, wherein each of said strips includes a pair of spaced-apart, upstanding wall parts, said endless supply line conveyor disposed between said wall parts.

5. An apparatus according to claim 1, wherein said cable conduit includes a second upper space and a second lower space, an endless extractor machine chain having an upper run movable in said second upper space and a lower run movable in said second lower space, said endless extractor machine chain adapted for connection to the extractor machine for moving the extractor machine along the long wall, and a plurality of yokes connected between said endless extractor machine chain and said endless supply line chain conveyor so that said endless extractor machine chain and said endless supply line chain conveyor move together.

* * * * *